United States Patent [19]

Côté

[11] Patent Number: 4,930,162

[45] Date of Patent: Jun. 5, 1990

[54] HOCKEY GLOVE HAVING LATERAL PADDED WART WITH SPLIT AND FLEXIBLE INSERT

[75] Inventor: Denis Côté, St-Hyacinthe, Canada

[73] Assignee: Sport Maska Inc., St-Hyacinthe, Canada

[21] Appl. No.: 275,186

[22] Filed: Nov. 23, 1988

[51] Int. Cl.[5] ..... A41D 13/08; A41D 19/00

[52] U.S. Cl. ..... 2/161 A; 2/16; 2/163

[58] Field of Search ..... 2/16, 18, 20, 159, 160, 2/161 A, 161 R, 163, 165, 158

[56] References Cited

U.S. PATENT DOCUMENTS

| | | | |
|---|---|---|---|
| 1,841,193 | 1/1932 | Lidston | 2/16 |
| 2,217,377 | 10/1940 | Moore | 2/161 R |
| 3,152,338 | 10/1964 | Strauss | 2/163 |
| 3,582,992 | 6/1971 | Gold | 2/16 |
| 3,605,117 | 9/1971 | Latina | 2/16 |
| 3,626,515 | 12/1971 | Murray | 2/16 |
| 3,997,922 | 12/1976 | Huhta | 2/161 A |
| 4,494,249 | 1/1985 | Hansson | 2/163 X |
| 4,497,073 | 2/1985 | Deutsch | 2/162 X |
| 4,561,122 | 12/1985 | Stanley et al. | 2/20 |
| 4,677,698 | 7/1987 | Angas | 2/16 X |

*Primary Examiner*—Werner H. Schroeder
*Assistant Examiner*—Sara M. Current
*Attorney, Agent, or Firm*—Fleit, Jacobson, Cohn, Price, Holman & Stern

[57] ABSTRACT

A protective sports glove for hockey, lacrosse, or the like, having a first elongated padded wart provided on the lateral exposed region of the glove proximate the forefinger and thumb receiving portions. The first padded wart is split into two sections which flexibly are joined together by an elastic insert member. A second padded wart is provided adjacent the first padded wart. The first and second padded warts provide protection of the lateral region of the forefinger and hand, and the flexible insert member of the first padded wart maintains sufficient flexiblity of the glove to allow a user comfortably and effectively to grip a hockey or lacrosse stick.

5 Claims, 2 Drawing Sheets

HOCKEY GLOVE HAVING LATERAL PADDED WART WITH SPLIT AND FLEXIBLE INSERT

BACKGROUND OF THE INVENTION

The present invention relates to a protective sports glove, and more particularly to a padded hockey glove having a lateral finger protection pad with a flexible insert to allow flexing of the hand to grip the handle of a hockey stick, and yet to protect the hand from injury.

In sports such as hockey and lacrosse, players require padded gloves to protect their fingers and hands from injury due to the fierce physical contact of the game. Typically, the glove includes padded finger stalls as well as padded portions for protecting the hand, wrist, and lower forearm. The padded finger stalls typically include slits in the padding and in the leather covering the stalls. The slits are themselves covered with leather to give a preshaped bend to the glove.

Furthermore, it is recognized that the forefinger should have additional protection. To meet this need, it is common to provide padding along the exposed lateral edge of the forefinger between the thumb and forefinger. This padding protects the bones of the forefinger and hand from injury as a result of contact to the inner portion of the hand. The forefinger padding exists in various designs including thick and thin padded warts, as well as long and short padded warts. See, for example, U.S. Pat. No. 4,497,073 to Deutsch and U.S. Design Patent No. 257,909 to Brine. These patents disclose lacrosse gloves having padding overlying the sides of the hand, extending laterally from the padded pinky portion toward the wrist, and from the padded forefinger portion, between the thumb and forefinger, again toward the wrist. The padded wart protecting the forefinger in these designs extends only partially along the lateral portion of the forefinger and hand. As such, the wart provides only partial protection to the sides of the hand and exposed lateral portion of the forefinger.

In addition, it is known to provide a longer wart which may provide more protection for the forefinger. However, by placing an additional pad on the glove, which is a continuous piece, the flexibility of the glove needed for grasping a hockey or lacrosse stick is reduced.

The flexibility problem of the continuous piece wart has been recognized, and attempts have been made to alleviate this problem by slitting the wart and removing padding at the slit. Each separate portion of the wart then is covered with leather. However, while flexibility is enhanced, protection of the forefinger at the slit is eliminated by the removal of the padding.

SUMMARY OF THE INVENTION

It is a primary object of this invention to provide a protective sports glove having padding protection for the exposed lateral edge of the forefinger between the thumb and forefinger.

It is an additional object of this invention to provide a protective sports glove having protective padding along the exposed lateral edge of the forefinger to protect the forefinger and hand from injury, while including a slit in the glove material, and an elastic insert at the slit to allow flexibility of the glove and comfort in gripping an element such as a hockey or lacrosse stick.

The present invention comprises a protective sports glove, particularly for hockey, lacrosse or the like, having a padded hand portion, cuff portion, and finger and thumb receiving portions. In addition, an elongated padded wart is provided on the exposed lateral edge of the padded forefinger receiving portion. The elongated padded wart has the glove material split at the knuckle into at least two sections, and the sections are joined by an elastic insert. Furthermore, a conventional shorter padded wart is provided adjacent the elongated wart on the exposed lateral edge of the padded thumb stall. Total protection of the hand thus is afforded by the above-described glove structure, and yet the flexibility of the glove is enhanced to permit comfortable gripping of a hockey or lacrosse stick.

The above and other objects and advantages will become more apparent when reference is made to the following description, taken in conjunction with the accompanying drawings.

DETAILED DESCRIPTION OF THE DRAWINGS

Figure 1:
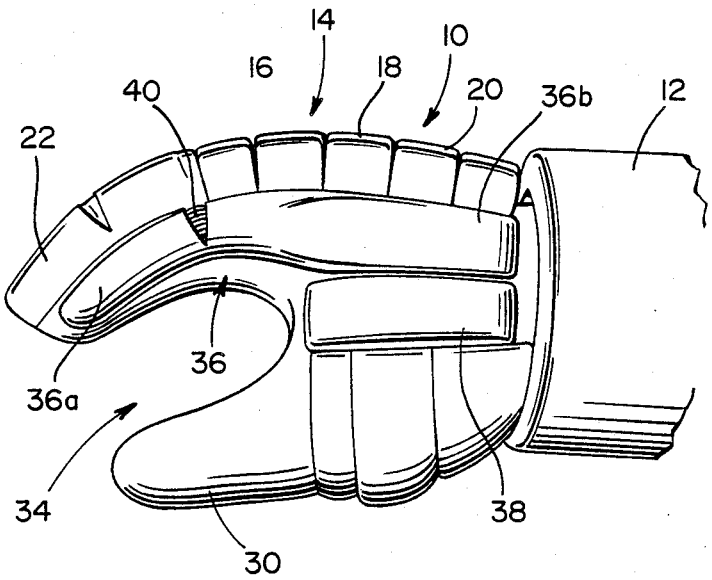
FIG. 1 is a side view of the protective sports glove in accordance with the present invention.
Figure 2:
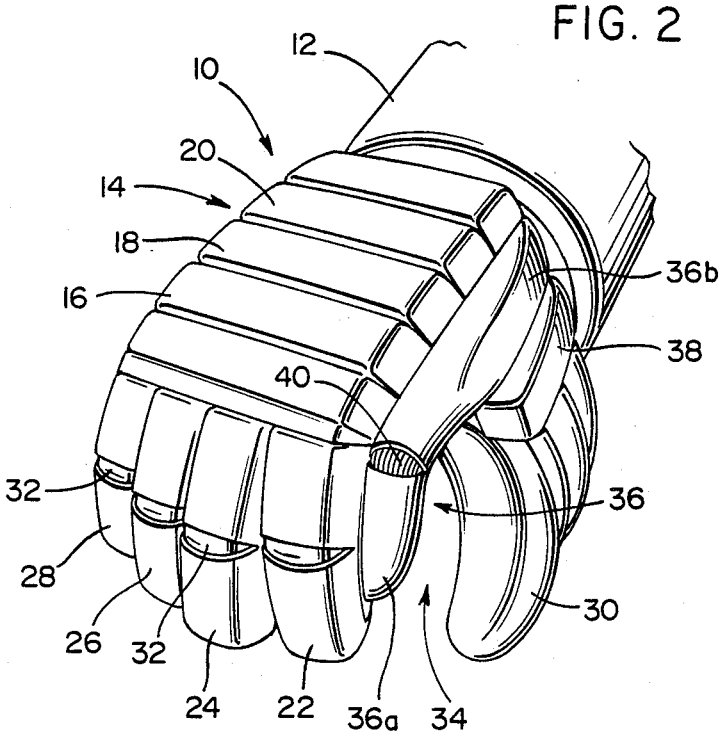
FIG. 2 is a front perspective view of the protective sports glove of FIG. 1.

Referring to FIGS. 1 and 2, the protective sports glove in accordance with the present invention is generally shown at 10. The glove 10 includes a padded cuff portion 12 for protecting the wrist and lower forearm of a user. A padded hand portion 14 is provided which typically includes a plurality of raised, discrete padded transverse portions 16, 18 and 20.

A plurality of padded finger and thumb receiving stalls are provided for affording protection of the extremities of the hand. Specifically, the glove 10 includes a forefinger stall 22, a middle finger receiving stall 24, a ring finger receiving stall 26, a pinky receiving stall 28, and a thumb receiving stall 30. Typically, the finger receiving stalls 22–28 include slits 32 for provided flexibility at the knuckles of the fingers.

The thumb and finger stalls 30, and 22–28, hand portion 14, and cuff portion 12 are filled with padding material and encased completely with leather. The slits 32 in the finger stalls 22–28 comprise discontinuities in the leather encasing the stalls and in the padding material. The discontinuities are encased by leather to enclose the padding material in each finger stall 20–26, and to provide a preshaped bend to the glove 10. The padding material used in glove 10 is typically a conventional foam padding or the like.

To provide protection for the exposed lateral portion 34 of the hand, padded warts 36 and 38 are provided Padded wart 36 is provided along the length of the forefinger stall 22 and extends to the cuff portion 12 of the glove 10. The short padded wart 38 is conventional and well known in the art. Typically, the wart 38 is provided on the exposed lateral portion of the glove between thumb stall 30 and the forefinger stall 32. The padded warts 36 and 38 are filled with the same material as that used to pad the finger receiving stalls and also are covered by leather.

The leather covering of the padded wart 36 is split, preferably at the intermediate knuckle of the forefinger, into two sections **36*a* and 36*b*, and an elastic insert 40 is provided to join together the split sections. Typically, the elastic insert is formed of Lycra elastic material, sold under the tradename of Spandex elastic material. The padding of the wart 36 is not split, but is covered by the elastic insert 40**. Therefore, padding protection at the split is maintained.

Figure 3:
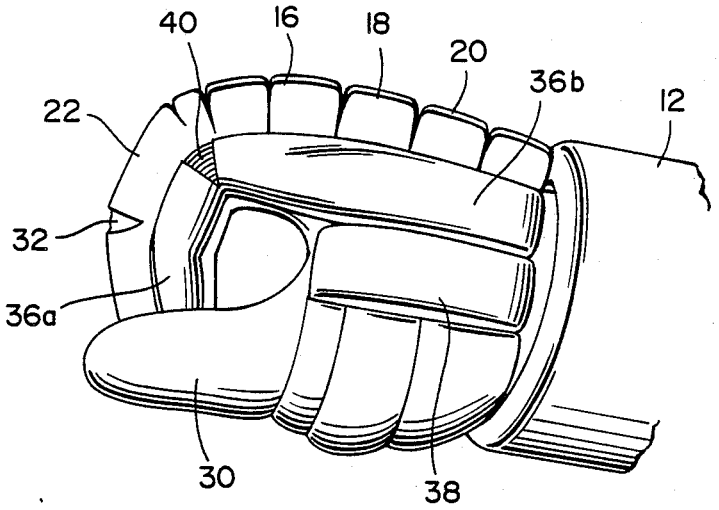
FIG. 3 is a side view of the protective sports glove illustrating the flexibility of the glove in accordance with the present invention.

By the above-described structure, the glove 10 provides total protection of the hand including the exposed lateral region 34. In addition, although the material forming the glove 10 is a relatively rigid leather, the provision of elastic insert 40 allows a user to close the hand easily at the forefinger (See FIG. 3) to grip a hockey or lacrosse stick securely and yet comfortably.

It is to be understood that the above description is intended by way of example only, and is not intended to limit the present invention in any way, except as set forth in the following claims.

I claim:

1. A protective sports glove for protecting a hand of a user, said protective sports glove comprising:

a hand receiving portion adapted to receive and enclose the hand;

respective padded finger receiving portions for receiving the forefinger, middle finger, ring finger, and pinky of the hand;

a padded thumb receiving portion for receiving the thumb of the hand;

a padded cuff portion for enclosing the wrist and lower forearm of the user;

an elongated covered and padded wart extending substantially along the length of said forefinger receiving portion and said hand receiving portion to said cuff portion and facing laterally outwardly from the forefinger receiving portion of said glove, the covering of said padded wart being split into first and second sections to allow flexibility of the glove and comfort in gripping an element; and an elastic insert member for flexibly joining together the covering of said first and second sections of said padded wart.

2. The protective sports glove of claim 1, and further comprising a further padded wart provided on said glove adjacent said padded wart and proximate said thumb receiving portion.

3. The protective sports glove of claim 1, wherein the covering of said padded wart is split proximate an intermediate knuckle of said forefinger.

4. A protective sports glove for protecting the hand of a user, said protective sports glove comprising:

a hand receiving portion adapted to receive and enclose a hand;

respective padded finger receiving portions for receiving the forefinger, middle finger, ring finger, and pinky of the hand;

a padded thumb receiving portion for receiving the thumb of the hand;

a padded cuff portion for enclosing the wrist and lower forearm of the user;

said hand receiving portion and said forefinger receiving portion defining a lateral exposed region of said glove;

a first elongated covered padded wart extending substantially along the length of said lateral exposed region of sad glove, and facing outwardly from said lateral exposed region, the covering of said first padded wart being split into first and second sections to allow flexibility of the glove and comfort in gripping an element;

an elastic insert member flexibly joining together the covering of said first and second sections of said first padded wart; and a second padded wart provided on said glove adjacent said first padded wart and proximate said thumb receiving portion.

5. The protective sports glove of claim 4, wherein the covering of said first padded wart is split proximate an intermediate knuckle of said forefinger.

* * * * *